United States Patent [19]

Nelson

[11] Patent Number: 4,960,172

[45] Date of Patent: Oct. 2, 1990

[54] CASING HANGER SEAL ASSEMBLY WITH DIVERGING TAPER

[75] Inventor: John E. Nelson, Houston, Tex.

[73] Assignee: Vetco Gray Inc., Houston, Tex.

[21] Appl. No.: 395,809

[22] Filed: Aug. 18, 1989

[51] Int. Cl.[5] ..... E21B 33/04

[52] U.S. Cl. ..... 166/208; 166/217; 285/145; 285/348

[58] Field of Search ..... 166/85, 101, 118, 125, 166/138, 206, 208, 216, 217; 285/80, 144–148, 140, 315, 339–341, 382.4

[56] References Cited

U.S. PATENT DOCUMENTS

| | | | |
|---|---|---|---|
| 2,714,932 | 8/1955 | Thompson | 166/138 |
| 2,805,723 | 9/1957 | Young | 166/216 |
| 4,665,979 | 5/1987 | Boehm | 166/208 |
| 4,722,391 | 2/1988 | Brammer | 166/195 |
| 4,742,874 | 5/1988 | Gullion | 166/348 |
| 4,766,956 | 8/1988 | Smith et al. | 166/182 |

*Primary Examiner*—Ramon S. Britts
*Assistant Examiner*—Ezio Di Sante
*Attorney, Agent, or Firm*—James E. Bradley

[57] ABSTRACT

A seal assembly for a casing hanger utilizes diverging tapered surfaces. The casing hanger locates within a wellhead housing. The casing hanger has an outer wall spaced inward from an inner wall of the wellhead housing, defining an annular clearance. At least one of the inner or outer walls has a tapered or conical sealing section. The taper is downward, resulting in increased radial width of the annular clearance in a downward direction. A metal packoff locates in the annular clearance. The packoff has inner and outer legs which are spread apart by means of an energizing ring. The legs seal against the casing hanger outer wall and wellhead housing inner wall.

5 Claims, 2 Drawing Sheets

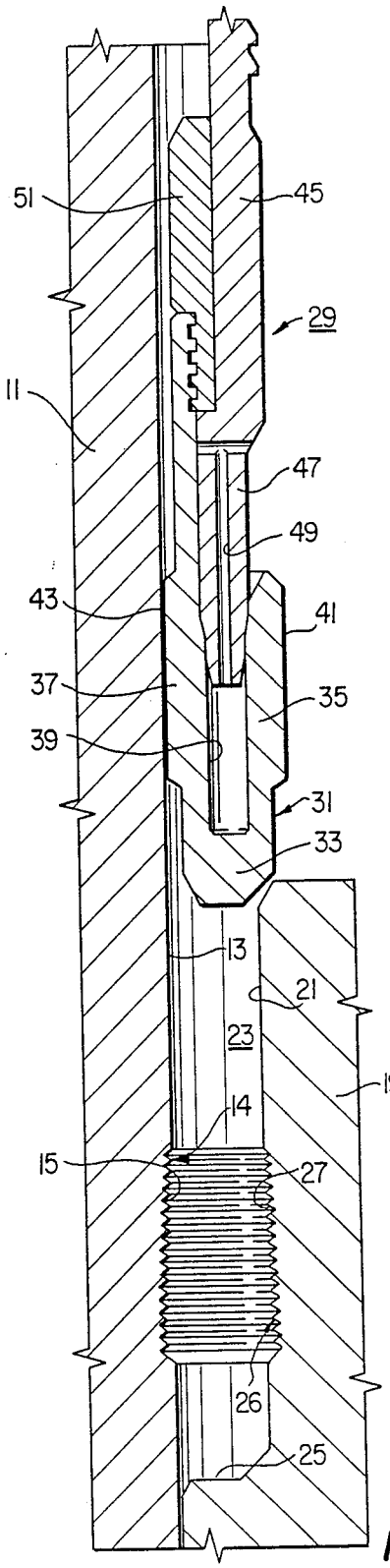
FIG. 1
FIG. 2
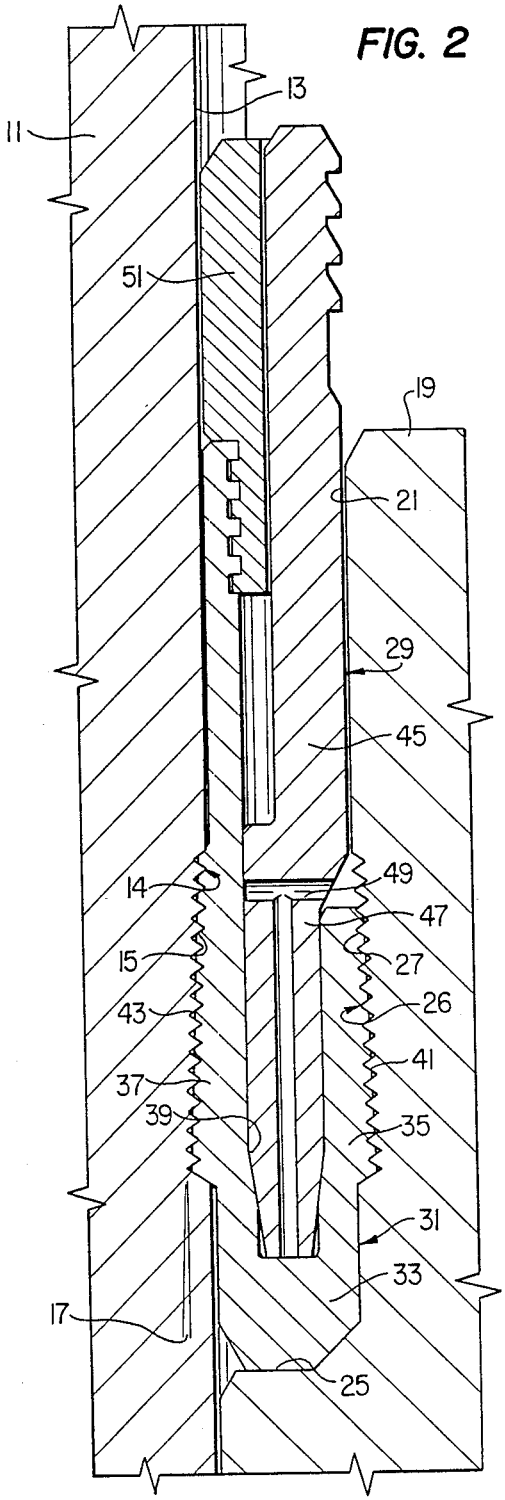

CASING HANGER SEAL ASSEMBLY WITH DIVERGING TAPER

BACKGROUND OF THE INVENTION

1. Field of the Invention:

This invention relates in general to a packoff for sealing between a casing hanger and a wellhead housing, and in particular to a packoff having tapered sealing surfaces.

2. Description of the Prior Art:

In a subsea well, a casing hanger will be secured to a string of casing and lowered into a wellhead housing. The wellhead housing will be located on the sea floor. There will be an annulus or clearance between the outer wall of the casing hanger and the wellhead housing bore wall. After the casing has been cemented, a packoff will be installed in this annular clearance to seal the annulus surrounding the casing A wide variety of designs for packoffs have been used and have been shown in patents. Some use elastomeric seals. Others use a combination of metal and elastomeric. Other types use metal only. One type of metal-to-metal seal has a seal member with annular inner and outer legs or walls separated by a slot. The outer leg seals against the wellhead housing. The inner leg seals against the casing hanger. The energizing member will move downward in the slot to expand the legs radially to accomplish the seal.

In some types of casing hanger seals, the wellhead bore wall and the casing hanger outer wall will be cylindrical and concentric The packoff will land on a shoulder formed on the exterior of the casing hanger below the sealing areas. In another type, the outer wall of the casing hanger in the sealing area will be slightly conical The sealing surface will taper from a larger diameter at the base to a smaller diameter at the top. This results in an annular clearance that decreases in radial width in a downward direction. In these types, the packoff will wedge into the annular clearance, rather than landing on an upward facing shoulder.

SUMMARY OF THE INVENTION

In this invention, the packoff is a type having inner and outer legs separated by an annular slot. An annular clearance will exist between the bore inner wall and the casing hanger outer wall. At least one of the walls will have a tapered section. This tapered section is generally conical, but tapered in an opposite direction to the ones in the prior art. This results in the annular clearance in this tapered area increasing in radial width in a downward direction.

In the preferred embodiment, both the casing hanger outer wall and the bore inner wall have tapered sections. Also, preferably these tapered sections contain wickers.

BRIEF DESCRIPTION OF THE DRAWINGS

FIG. 1 shows a portion of a casing hanger, wellhead housing, and seal member constructed in accordance with this invention and shown in a running-in position.

FIG. 2 is a cross-sectional view of the seal of FIG. 1, showing it in an energizing position.

DETAILED DESCRIPTION OF THE INVENTION

Figure 3:
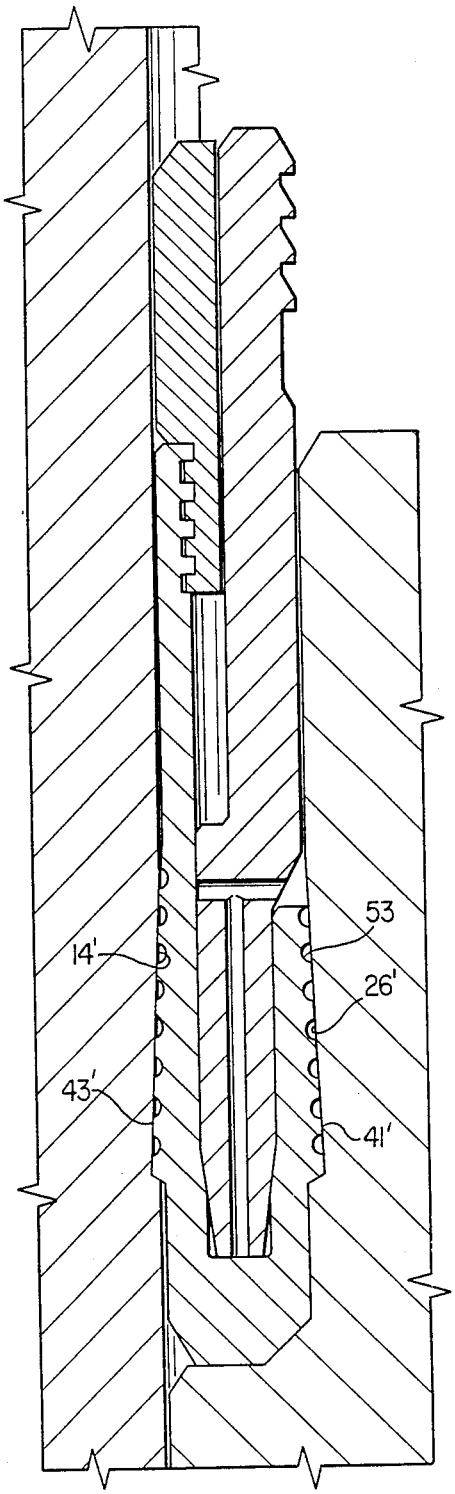
FIG. 3 is an alternate embodiment of a seal constructed accordance with this invention, and shown in an energized condition.

Referring to FIG. 1, wellhead housing 11 is a tubular member which in this invention will normally be located on a subsea floor. Wellhead housing 11 has a bore wall 13 that is cylindrical. A tapered section 14 will be formed into bore wall 13. The tapered section 14 is generally conical. It has a larger diameter at the bottom than at the top. It tapers in a downward direction at an angle 17 (FIG. 2) that is about 5 degrees relative to the longitudinal axis of the wellhead housing 11.

A set of wickers 15 are formed on the tapered section 14 The wickers 15 are small, parallel, circumferential grooves. Each wicker 15 is triangular in cross-section with upper and lower flanks that incline the same amount relative to the longitudinal axis of the wellhead housing 11. The wickers 15 have a constant depth, which is preferably about one-eighth inch.

A casing hanger 19 will be secured to a string of casing (not shown) and lowered into the well. The casing hanger 19 will land on a landing profile (not shown) located in the bore of the wellhead housing 11. Casing hanger 19 has an upper portion with an outer wall 21. The outer wall 21 is generally cylindrical and spaced inward from the bore wall 13. This results in an annular clearance 23. An upward facing shoulder 25 will be located at the lower end of the annular clearance 23.

The outer wall 21 has a tapered section 26. The tapered section 26 is positioned to align with the bore of tapered section 14 when the casing hanger 19 lands in the wellhead housing 11. Tapered section 26 is of the same axial length as the tapered section 14. Tapered section 26 is also conical It diverges in the opposite direction from the tapered section 14. It has a larger diameter on its upper end than on its lower end. It has a downward taper that is at the same angle as the angle 17 of the tapered section 14.

A set of wickers 27 are located on the tapered section 26. Wickers 27 are identical to the wickers 15. The tapered sections 14 and 26 result in the annular clearance 23 having an increasing radial width measured from the top of the tapered sections 14, 26 to the bottom A metal packoff or seal 29 will locate within the annular clearance 23 and seal the bore wall 13 and casing hanger wall 21. Seal 29 includes an annular seal member 31. Seal member 31 has a base 33 on its lower end that is circular. An inner wall or leg 35 extends upward from base 33. An outer wall or leg 37 extends upward from base 33 and radially outward from the inner leg 35 Base 33 thus joins the inner leg 35 with the outer leg 37. The inner leg 35 and outer leg 37 are separated by an annular slot 39. The base 33 forms the lower end of the slot 39. The upper end is open.

The inner leg 35 has an inner sealing surface 41 that faces radially inward The sealing surface 41 is cylindrical prior to sealing against the tapered section 26. After sealing, the sealing surface 41 conforms to the taper of the tapered section 26. Similarly, an outer sealing surface 43 on the outer leg 37 is cylindrical initially. Subsequently, it conforms to the taper of the tapered section 14. In the embodiment of FIG. 1, the sealing surfaces 41, 43 are smooth.

Seal 29 includes an energizing ring 45. Energizing ring 45 has a lower portion 47 that initially will be at the upper end of the slot 39. The radial width of the lower portion 47 is greater than the radial width of the slot 39.

The energizing ring 45 will move to a lower position, shown in FIG. 2, spreading the inner and outer legs 35, 37 radially apart. The lower portion 47 has passages 49 to allow fluid contained within the slot 39 to be displaced. A retainer 51 will retain the energizing ring 45 with the seal member 31. The retaining ring 51 also allows the energizing ring 45 to be pulled back upward if it is desired to remove the seal 29 at a later time.

In operation, the casing hanger 19 will be secured to a string of casing (not shown) and lowered into the well. The casing hanger 19 will land on a landing profile (not shown) in the wellhead housing 11. Cement will be pumped down the casing hanger 19 to return up an annulus surrounding the casing. The seal 29 will initially be carried in an upper position, such as shown in FIG. 1, to enable cement returns to flow past the casing hanger 19.

After the cement has set, a running tool will lower the seal 29 into the annular clearance. The base 33 will contact the shoulder 25. Downward force on the energizing member 45 will move the lower portion 47 into the slot 39. It will move the inner and outer legs 35, 37 radially apart The inner sealing surface 41 will embed into the wickers 27. The outer sealing surface 43 will embed into the wickers 15. Any pressure in the annulus acting on the seal 29 will cause the seal 29 to wedge even more tightly in the annular clearance 23 because of the tapered sections 14 and 26.

In the embodiment of FIG. 3, the tapered sections 14' and 26' have the same diverging taper as in the embodiment of FIGS. 1 and 2. However, the tapered sections 14' and 26' do not contain wickers such as the wickers 15, 27 of the first embodiment Also, the inner sealing 41' and the outer sealing surface 43' are not smooth surfaces. Rather, each contain a set of circumferential grooves 53. The grooves 53 are semi-circular in cross-section. Each has a band which is a portion of a cylindrical surface located between them. The embodiment of FIG. 3 will operate in the same manner as the first embodiment.

The invention has significant advantages. The tapered sections enhance pressure sealing capability. The diverging tapers increase retention of the seal. The diverging tapers also have a replenishment effect of the sealing surfaces by reducing the possibility of slippage of the seal within the wickers.

While the invention has been shown in only two of its forms, it should be apparent to those skilled in the art that its not so limited but is susceptible to various changes without departing from the scope of the invention.

I claim:

1. In a well having a wellhead housing with a bore defining an inner wall, a casing hanger located in the bore and having an outer wall radially spaced from the inner wall of the wellhead housing, defining an annular clearance, an improved means for sealing the annular clearance, comprising in combination:

a downward inclined tapered section on at least one of the walls in the annular clearance, defining a width of the annular clearance in the tapered section which increases in a downward direction;

a metal seal member for sealing in the annular clearance, having annular inner and outer legs radially spaced apart from each other to define an annular slot, the outer leg having an outer sealing surface, the inner leg having an inner sealing surface, the inner and outer sealing surfaces being of substantially the same length;

the tapered section having an axial length that is substantially the same axial length as the inner and outer sealing surfaces;

the seal member being movable downward from an initial position located above the tapered section during cementing to a setting position with its outer sealing surface facing the inner wall of the wellhead and its inner sealing surface facing the outer wall of the casing hanger, and with one of the sealing surfaces located adjacent the tapered section; and an energizing member carried with the seal member for movement from an upper position to a lower position within the slot after the seal member is in the setting position for wedging the legs of the seal member radially apart, and for forcing one of the sealing surfaces into sealing engagement with the tapered section.

2. In a well having a wellhead housing with a bore defining an inner wall, a casing hanger located in the bore and having an outer wall radially spaced from the inner wall of the wellhead housing, defining an annular clearance, an improved means for sealing the annular clearance, comprising in combination:

a downward inclined tapered section on at least one of the walls in the annular clearance, defining a width of the annular clearance in the tapered section which increases in a downward direction;

a metal seal member for sealing in the annular clearance, having annular inner and outer legs radially spaced apart from each other to define an annular slot, the outer leg having an outer sealing surface for sealing contact with the inner wall of the wellhead housing, the inner leg having an inner sealing surface for sealing contact with the outer wall of the casing hanger, the inner and outer sealing surfaces being of substantially the same length;

the tapered section having an axial length that is substantially the same axial length as the inner and outer sealing surfaces;

the seal member being movable downward from an initial position located above the tapered section during cementing to a setting position with its outer sealing surface facing the inner wall of the wellhead, and its inner sealing surface facing the outer wall of the casing hanger and with one of its sealing surfaces located adjacent the tapered section; and an energizing member carried with the seal member for movement from an upper position to a lower position within the slot for wedging the legs of the seal member radially apart, each of the sealing surfaces having a substantially cylindrical configuration when the energizing member is in the upper position, at least one of the sealing surfaces being deformable to the tapered configuration of the tapered section by movement of the energizing member to the lower position.

3. In a well having a wellhead housing with a bore defining an inner wall, a casing hanger located in the bore and having an outer wall radially spaced from the inner wall of the wellhead housing, defining an annular clearance, an improved means for sealing the annular clearance, comprising in combination:

a downward inclined tapered section on the inner wall of the wellhead housing;

a downward inclined tapered section on the outer wall of the casing hanger adjacent the tapered section on the inner wall of the wellhead housing, the tapered sections converging toward each other from the bottom to the top, resulting in a width of the annular clearance in the tapered sections which increases in a downward direction;

a metal seal member for sealing in the annular clearance, having annular inner and outer legs radially spaced apart from each other to define an annular slot, the outer leg having an outer sealing surface for sealing contact with the inner wall of the wellhead housing, the inner leg having an inner sealing surface for sealing contact with the outer wall of the casing hanger; and an energizing member carried with the seal member for movement from an upper position to a lower position within the slot for wedging the legs of the seal member radially apart.

4. In a well having a wellhead housing with a bore defining an inner wall, a casing hanger located in the bore and having an outer wall radially spaced from the inner wall of the wellhead housing, defining an annular clearance, an improved means for sealing the annular clearance, comprising in combination:

a downward inclined tapered section on at least one of the walls in the annular clearance, resulting in a width of the annular clearance in the tapered section which increases in a downward direction;

a set of wickers formed on the downward inclined tapered section;

a metal seal member for sealing in the annular clearance, having annular inner and outer legs radially spaced apart from each other to define an annular slot, the outer leg having an outer sealing surface for sealing contact with the inner wall of the wellhead housing, the inner leg having an inner sealing surface for sealing contact with the outer wall of the casing hanger, the inner and outer sealing surfaces being of substantially the same length;

the tapered section having an axial length that is substantially the same axial length as the inner and outer sealing surfaces;

the seal member being movable downward after installation of the casing hanger to a setting position with its outer sealing surface facing the inner wall of the wellhead, and its inner sealing surface facing the outer wall of the casing hanger and with one of its sealing surfaces located adjacent the tapered section; and an energizing member carried with the seal member for movement from an upper position to a lower position within the slot for wedging the legs of the seal member radially apart, the sealing surfaces being substantially vertical in cross-section when the energizing member is in the upper position and at least one of the sealing surfaces deforming to the tapered configuration of the tapered section after the energizing member is in the lower position.

5. In a well having a wellhead housing with a bore defining an inner wall, a casing hanger located in the bore and having an outer wall radially spaced from the inner wall of the wellhead housing, defining an annular clearance, an improved means for sealing the annular clearance, comprising in combination:

a downward inclined tapered section on at least one of the walls in the annular clearance, resulting in a width of the annular clearance in the tapered section which increases in a downward direction;

a metal seal member for sealing in the annular clearance, having annular inner and outer legs radially spaced apart from each other to define an annular slot, the outer leg having an outer sealing surface for sealing contact with the inner wall of the wellhead housing, the inner leg having an inner sealing surface for sealing contact with the outer wall of the casing hanger, the inner and outer sealing surfaces being of substantially the same length;

the tapered section having an axial length that is substantially the same axial length as the inner and outer sealing surfaces;

a plurality of parallel grooves contained on the inner and outer sealing surfaces;

the seal member being movable downward from an initial position located above the tapered section during cementing to a setting position with its outer sealing surface facing the inner wall of the wellhead, and its inner sealing surface facing the outer wall of the casing hanger and with one of its sealing surfaces located adjacent the tapered section; and an energizing member carried with the seal member for movement from an upper position to a lower position within the slot for wedging the legs of the seal member radially apart, the seal member being substantially constant in radial thickness from one of the sealing surfaces to the other when the energizing member is in the upper position and at least one of the sealing surfaces deforming to the tapered configuration of the tapered section after the energizing member is in the lower position.

* * * * *